United States Patent [19]
Bitely, Jr. et al.
[11] 4,213,868
[45] Jul. 22, 1980

[54] GALVANIC CORROSION PREVENTION COUPLING

[75] Inventors: Clarence J. Bitely, Jr., Limestone, N.Y.; Luther D. Dromgold, Bradford, Pa.; William S. Murray, Jr., Rumson, N.J.

[73] Assignee: Witco Chemical Corporation, New York, N.Y.

[21] Appl. No.: 955,546

[22] Filed: Oct. 27, 1978

[51] Int. Cl.[2] ..... C10M 1/24; C10M 3/18; C10M 1/18; C10M 3/12

[52] U.S. Cl. ..... 252/11; 204/148; 252/39; 252/41; 252/389 R; 285/94; 585/10

[58] Field of Search ..... 252/39, 41, 59, 389 R, 252/11; 285/94; 204/148; 585/10

[56] References Cited

U.S. PATENT DOCUMENTS

| | | | |
|---|---|---|---|
| 1,884,749 | 10/1932 | Kocour | 204/148 |
| 2,240,021 | 4/1941 | Rutherford | 204/148 |
| 2,533,840 | 12/1950 | Roehner et al. | 204/148 |
| 2,810,695 | 10/1957 | Young et al. | 252/41 |
| 2,827,313 | 3/1958 | Conner | 285/94 |
| 3,069,387 | 12/1962 | Allen et al. | 285/94 |
| 3,290,244 | 12/1966 | Polishuk et al. | 252/41 |
| 3,939,082 | 2/1976 | Williams et al. | 252/41 |

*Primary Examiner*—Delbert E. Gantz
*Assistant Examiner*—Irving Vaughn
*Attorney, Agent, or Firm*—Albert L. Gazzola; Morton Friedman

[57] ABSTRACT

A coupling having dissimilar metal mating parts is provided with a grease comprising a hydrocarbon base oil containing a stearate gelling agent, particularly a Na, Li or Ba stearate. This coupling is anti-galvanic corrosive. Such couplings are useful in fire-fighting equipment where often aluminum and bronze components are in mating relationship, such as fire hose adaptors and hose nozzles.

13 Claims, No Drawings

GALVANIC CORROSION PREVENTION COUPLING

FIELD OF THE INVENTION

This invention relates to a grease in a coupling of dissimilar metals which prevents galvanic corrosion.

BACKGROUND OF THE INVENTION

It is known that dissimilar metal couples may exhibit extreme galvanic corrosion when a significant electromotive force difference exists between the two metals, in an electrically conductive environment, such as salt water.

Heretofore it was known to provide corrosion preventive grease formulations for protection of specific metals in corrosive atmospheres. Such typical greases are disclosed in U.S. Pat. Nos. 3,981,810; 3,850,823; 3,816,310; 3,781,218; and 3,623,982.

In certain industries greases based on petroleum oil compositions were not entirely satisfactory and synthetic oils were employed. Such synthetic oils however induced corrosion and certain treatment was made to the synthetic oils to prevent corrosion, as disclosed in U.S. Pat. No. 3,793,197 granted Feb. 19, 1974.

U.S. Pat. No. 3,383,328, granted May 14, 1968, to Baker and Leach, refers to corrosion protection of metal couples, specifically stainless steel to aluminum. The active ingredient disclosed is a reaction product of an amine and unsaturated fatty acid.

Many industries rely on grease compositions based on various types of petroleum or snythetic components and various types of soap or non-soap thickeners. Such compositions may include additives to achieve certain specific properties such as rust protection, and the primary purpose of such grease compositions is generally for use as a lubricant. However, such grease formulations have not been known to give corrosion protection between dissimilar metals such as bronze and aluminum.

Many industries however continue to rely on greases based on petroleum oil compositions which generally prove satisfactory as lubricants except where dissimilar mating metals were used. In such cases these greases did not avoid the galvanic corrosion caused by the dissimilar metals when water is present.

A specific problem area is the rapid galvanic corrosion that takes place between a metal coupling of bronze and aluminum, in the presence of a corrosive atmosphere, as is used in some types of fire-fighting equipment. For obvious reasons threaded connections between the bronze and aluminum components must be readily moveable, generally manually moveable without any specific tools. Extreme galvanic corrosion can prevent adjustment of the fire hose nozzle water flow or disassembly of the threaded parts.

Now, there is provided by the present invention a dissimilar metal coupling with a petroleum oil base grease composition which prevents the galvanic corrosion heretofore encountered.

More particularly by the present invention a coupling is made available wherein the bronze and aluminum mating parts such as in fire-fighting equipment are not subject to galvanic corrosion.

The aforesaid as well as other objects and advantages will become apparent from a reading of the following specification and the adjoined claims:

DESCRIPTION OF THE PREFERRED EMBODIMENTS

Broadly speaking the present invention includes the combination of a coupling of dissimilar metals and a petroleum oil based grease composition comprising a certain class of gelling agents, which coupling is not subject to galvanic corrosion. In a less broad aspect of the present grease composition the gelling agent is a stearate. In a more specific aspect a hydrocarbon resin is combined with the gelling agent and the hydrocarbon base oil, as the anti-galvanic composition.

Any suitable hydrocarbon base oil useful in greases, as is well known to one skilled in the art, is suitable in the present invention. The hydrocarbon base oils may contain aliphatic as well as aromatic constituents. Typical of such oils are the paraffinic and naphthenic base oils. Usually the viscosity of the oil is 1.5 to 20.0 centistokes and preferable 7 to 20.0 centristokes at 100° C.

Useful gellation agents pursuant to this invention include soaps prepared with certain members of the alkali elements (Group 1a of the Periodic Table) namely Li and Na; and with certain members of the alkaline earth elements (Group 2a of the Periodic Table) namely Ba. Preferred gelling agents include sodium stearate, barium stearate and lithium 12-hydroxy stearate.

The gelling agent may be present in about 5 to 40 percent by weight and preferably, wherein the gelling agent is sodium stearate, 15 to 20 percent by weight of the grease composition; and wherein it is lithium stearate, 5 to 10 percent by weight of the grease composition; and wherein it is barium stearate, 25 to 40 percent by weight of the composition.

It has also been surprisingly found that small amounts of a hydrocarbon resin in combination with the gelling agent provides improved anti-corrosive effect. The hydrocarbon resin should generally be present in 0.5 to 5.0 weight percent and preferably 0.5 to about 1.5 weight percent of the grease composition.

Suitable hydrocarbon resins pursuant to the present invention are the thermoplastic polymers, particularly the polyolefins, such as polyethylene, polypropylene, polybutene and copolymers thereof as is known in the art. Other hydrocarbon resins are also within the contemplation of this invention.

The anti-corrosion greases of this invention are found to be useful in the prevention of corrosion in couplings wherein mating parts of dissimilar metals are present. By the term "coupling" it is meant any assembly of two metals in mating contact, such as in threaded parts, and hose and nozzle assemblies. Particularly this invention is directed to the hose and nozzle parts of fire-fighting equipment wherein dissimilar metals such as aluminum and bronze are in mating relationship. Typical of such fire-fighting equipment are hose nozzles, quarter-turn adaptors, and the like.

This invention contemplates particular use wherein the metals are highly dissimilar as determined by the relative positions of the metals in the electromotive force series.

The following examples are illustrative of the invention.

EXAMPLE I

The following greases were prepared:

GREASE A: was prepared by blending 17 percent sodium stearate as the gelling agent with 83 percent of a hydrocarbon base oil having a viscosity of about 220 centistokes at 40° C. After working the stearate into the oil, the final grease exhibited a penetration of 265–295 (ASTM D-217).

GREASE B: was prepared in a manner similar to that of Grease A but with the further addition of a polypropylene hydrocarbon resin having a Ring and Ball Softening Point of 230° F. (ASTM E-28).

GREASE C: was prepared by blending 6.5 percent of a lithium soap of hydrogenated castor oil; 90 percent of a hydrocarbon base oil having a viscosity of 15.5 centistokes at 100° C.; 3 percent of a calcium sulfonate rust inhibitor; and 0.5 percent of an oxidation inhibitor.

GREASE D: was prepared by blending 8 percent by weight of a pyrolytic silica; 1.5 percent by weight of a polyhydroxy activator; and 90.5 percent of a hydrocarbon base oil having a viscosity of about 15.5 centistokes at 100° C.

GREASE E: was prepared by blending 9 percent by weight of a Bentone thickening agent and 91 percent by weight of a hydrocarbon base oil having a viscosity of 19.5 centistokes at 100° C.

GREASE F: was prepared by blending a petrolatum with a hydrocarbon neutral base oil; said blending having a melting point of about 95° F.

GREASE G: was prepared by blending 35 percent of barium stearate as the gelling agent with 65 percent of a hydrocarbon base oil having a viscosity of about 6 centistokes at 100° C.

The following tests were conducted with Greases A–G;

Test 1

Mated machine threaded components involving aluminum as one component and bronze as the other component were evaluated with no grease, Grease A, and Grease B, using a 5 percent salt fog as per ASTM B-117. Assemblies without any protection could not be unthreaded at the end of 30 days. Assemblies protected with Grease A and Grease B showed no indication of corrosion in the threaded area at 300 days and could be readily unthreaded.

Test 2

Grease B was used to protect the tapered threaded area of pipe and fittings. The variety of metal couples employed in this test included steel to brass, brass to galvanized steel, galvanized steel to steel, steel to steel, and steel to aluminum. After 90 days of 5 percent salt fog exposure all threaded joints could be disassembled as readily as they had been assembled. No corrosion was noted in the threaded area. The test was terminated 90 days due to extreme corrosion of the unprotected portions of some of the components.

Test 3

Mated machine threaded components involving aluminum as one component and brass as one component were evaluated with Grease B and C using 5 percent salt fog (ASTM B-117). Both greases protected the threaded connections for a total of seven cycles of salt fog exposure. Each cycle comprised daily disassemblies-reassemblies for five days followed by twenty-four undisturbed days. Without protective grease the assembly became inoperative prior to twenty-four days in the undisturbed mode.

Test 4

Mated machine threaded components involving aluminum as one component and brass as one component were evaluated with no grease and with Grease B under the stated conditions with 1 percent salt brine at 70° F. The assemblies without protection could not be unthreaded at 23 days. The assemblies protected with Grease B were operable at 168 days.

Test 5

Mated machine threaded components involving aluminum as one component and brass as one component were evaluated with no grease, Grease B, Grease D, Grease E, Grease F and Grease G with 5 percent salt fog (ASTM B-117). Without protection, failure was noted within the initial 30 day test period. Grease D and Grease F failed between 30 and 60 days. Grease B, Grease E and Grease G protected the threaded area for over 180 days without failure.

EXAMPLE II

Greases A and B were prepared as per the previous example.

Three large fire hose adamptor; two small fire hose adaptors and two squelch nozzle couplings were used in the following tests. All the above assemblies involved bronze to aluminum components in mating relationships. The Greases A and B were applied to the threaded area of the aforesaid assemblies and the assemblies were hand tightened to a snug fit.

The three large adaptors were tested with (1) no grease, (2) Grease A, and (3) Grease B. The two small adaptors were tested with (1) no grease and (2) Grease A. The two squelch nozzles were tested with (1) no grease and (2) Grease A.

The salt fog cabinet was of a Type 411.3CG manufactured by International Filter and Pump Manufacturing Company. The procedure is defined in ASTM B-117-64, with the test time and positioning of the couplings as given by Underwriters Laboratories (Subject 236, Part 18, dated May 1976). The equipment was operated at 95° F. plus 2 minus 3° F. using 5 weight percent sodium chloride. Operation of the cabinet was evaluated during the test, as specified in ASTM B-117 parts 6 and 8*b*. The pH of the salt solution was determined as 6.85 (specified range of 6.7–7.2). The sodium chloride concentration of the collected solution was determined as 5.3 weight percent (specified range of 5.0+1 percent). The volume of collected salt fog was measured over separate 16 hour periods and averaged. The average was 1.625 ml. of solution per hour collected over the 80 square centimeter horizontal collecting surface (specified range of 1.0–2.0 ml.).

This cabinet did not have the automatic level control for the salt solution reservoir or the controller for the air saturator tower. These were manually controlled and checked at least every 24 hours during cabinet operation. No difficulties were encountered by this method of operation.

During the ninety day test time being reported only the unlubricated couplings were disturbed prior to the end of the test. At 21 days of salt fog testing, the unlubricated couplings were removed from the cabinet and evaluated for ease of disassembly. Each of the three styles of assemblies without grease could not be unthreaded. Galvanic corrosion had restricted separation.

These assemblies were returned to the cabinet to continue the test.

At ninety days all couplings were removed and evaluated for ease of disassembly. All unlubricated assemblies could not be unthreaded by hand, even by a man on each coupling end. All of the lubricated assemblies could be unthreaded by a single individual, by hand.

While the aforesaid demonstrates the anti-galvanic corrosion coupling aspects of the present invention, there is also demonstrated that a mere physical grease barrier between dissimilar metals is not effective in preventing galvanic corrosion, and that only certain compositions do so.

Although and as illustratively described in the foregoing examples, the compositions comprise a specific grease, it is within the scope of this invention to include in the compositions embodied herein other addition agents for imparting certain desired properties to the compositions. In illustration, the compositions embodied herein may also contain substances such as anti-oxidants, and the like.

It must be recognized by those skilled in grease formulation art that various additives may be included to impart other desired properties to the compositions. Such additives may function to reduce oxidation, rust, wear, etc. They may also function as solid lubricant constituents such as the hydrocarbon resin, etc.

Although the present invention has been described in combination with certain preferred embodiments thereof those skilled in the art will readily recognize that variations and modifications are to be considered within the purview of the specification and scope of the appended claims.

The embodiments of the invention in which an exclusive property or privilege is claimed are defined as follows:

1. An anti-galvanic corrosion coupling, consisting essentially of two dissimilar metals having a grease disposed therebetween, said grease consisting essentially of a hydrocarbon base oil and a stearate gelling agent selected from the class consisting of sodium, lithium and barium stearates.

2. The anti-corrosion coupling of claim 1, wherein the gelling agent is present in 5 to 40 percent by weight of the grease.

3. The anti-corrosion coupling of claim 1, wherein the one metal is aluminum and the other is bronze.

4. The anti-corrosion coupling of claim 1, said grease further comprising a hydrocarbon resin.

5. The anti-corrosion coupling of claim 4, wherein the resin is a polyolefin.

6. The anti-corrosive coupling of claim 5, wherein the resin is present as 0.5 to 5 percent by weight of the grease.

7. The anti-corrosion coupling of claim 1, wherein the coupling is a hose connection and wherein one metal is aluminum and the other is bronze.

8. The anti-corrosion coupling of claim 4, wherein said grease further comprising a polypropylene resin.

9. The anti-corrosion coupling of claim 1, wherein the viscosity of the base oil is 7 to 20.0 centistokes at 100° C.

10. The anti-corrosion coupling of claim 1, wherein the gelling agent is barium stearate.

11. The anti-corrosion coupling of claim 10, wherein the barium stearate is present in 25 to 40 percent by weight of the grease.

12. The anti-corrosion coupling of claim 1, wherein the gelling agent is lithium 12-hydroxy stearate.

13. The anti-corrosion coupling of claim 12, wherein the gelling agent is present in 5 to 10 percent by weight of the grease.

* * * * *